US006790135B2

(12) United States Patent
Yang

(10) Patent No.: US 6,790,135 B2
(45) Date of Patent: Sep. 14, 2004

(54) FINISHING MACHINE HAVING A SANDPAPER POSITIONING FUNCTION

(76) Inventor: Wen Liang Yang, No. 1, Lane 30, Tu-Cheng Rd., Ta-Li City, Taichung County (TW)

( * ) Notice: Subject to any disclaimer, the term of this patent is extended or adjusted under 35 U.S.C. 154(b) by 23 days.

(21) Appl. No.: 10/281,370

(22) Filed: Oct. 28, 2002

(65) Prior Publication Data

US 2004/0082282 A1 Apr. 29, 2004

(51) Int. Cl.[7] ..... B24D 17/00

(52) U.S. Cl. ..... 451/490; 451/514; 451/523; 451/524; 451/525; 451/520

(58) Field of Search ..... 451/490, 514, 451/523, 524, 525, 520

(56) References Cited

U.S. PATENT DOCUMENTS 4,058,936 A * 11/1977 Marton ..... 451/359

6,224,471 B1 * 5/2001 Clowers et al. ..... 451/359

* cited by examiner

*Primary Examiner*—Lee D. Wilson
*Assistant Examiner*—Alvin J Grant
(74) *Attorney, Agent, or Firm*—Charles E. Baxley

(57) ABSTRACT

A finishing machine having a sandpaper positioning function includes a frame, a rotation wheel rotatably mounted on the frame, a sandpaper bonded on the rotation wheel, and an O-ring mounted on the rotation wheel and urged on the sandpaper. The rotation wheel has a periphery formed with an annular flange radially extending inward. The annular flange has an inner periphery formed with an annular groove. The O-ring is inserted into the annular groove of the rotation wheel and urged on the annular flange of the rotation wheel so as to position the sandpaper rigidly and stably.

1 Claim, 5 Drawing Sheets

FINISHING MACHINE HAVING A SANDPAPER POSITIONING FUNCTION

BACKGROUND OF THE INVENTION

1. Field of the Invention

The present invention relates to a finishing machine having a sandpaper positioning function, and more particularly to a finishing machine having a sandpaper positioning function, wherein the O-ring may function as a positioning device so as to position the sandpaper on the rotation wheel rigidly and stably.

2. Description of the Related Art

A first conventional finishing machine in accordance with the prior art shown in FIGS. 5 and 6 comprises a frame (not shown), a rotation wheel 2 rotatably mounted on the frame, a sandpaper 3 bonded on the rotation wheel 2 to rotate therewith, and a ring-shaped fixing member 1 mounted on the rotation wheel 2 and urged on the sandpaper 3 for positioning the sandpaper 3 on the rotation wheel 2. Thus, the rotation wheel 2 is rotated at a high speed to rotate the sandpaper 3 so as to grind and finish the workpiece (not shown) on the sandpaper 3. The ring-shaped fixing member 1 has a substantially Z-shaped cross-section.

However, the ring-shaped fixing member 1 is made of steel, thereby increasing cost of fabrication. In addition, the inner rim of the ring-shaped fixing member 1 can easily hurt the user when operating at a high rotational speed. Further, the ring-shaped fixing member 1 can easily injure someone if it becomes detached from the rotating wheel 2 at a high rotational speed.

A second conventional finishing machine in accordance with the prior art shown in FIGS. 7 and 8 comprises a frame (not shown), a rotation wheel 5 rotatably mounted on the frame, a sandpaper 6 bonded on the rotation wheel 5 to rotate therewith, and a ring-shaped fixing member 4 mounted on the rotation wheel 5 and urged on the sandpaper 6 for positioning the sandpaper 6 on the rotation wheel 5. Thus, the rotation wheel 5 is rotated at a high speed to rotate the sandpaper 6 so as to grind and finish the workpiece (not shown) on the sandpaper 6. The ring-shaped fixing member 4 has a substantially L-shaped cross-section.

However, the ring-shaped fixing member 4 is made of steel, thereby increasing cost of fabrication. In addition, the inner rim of the ring-shaped fixing member 4 can easily hurt the user when operating at a high rotational speed. Further, the ring-shaped fixing member 4 can easily injure someone if it becomes detached from the rotating wheel 5 at a high rotational speed.

SUMMARY OF THE INVENTION

The present invention has arisen to mitigate and/or obviate the disadvantage of the conventional finishing machine.

The primary objective of the present invention is to provide a finishing machine having a sandpaper positioning function, wherein the O-ring may function as a positioning device so as to position the sandpaper on the rotation wheel rigidly and stably.

Another objective of the present invention is to provide a finishing machine having a sandpaper positioning function, wherein the positioning device has a cheap price, thereby decreasing cost of fabrication.

A further objective of the present invention is to provide a finishing machine having a sandpaper positioning function, wherein the positioning device is made of soft material, thereby preventing the user from being injured.

A further objective of the present invention is to provide a finishing machine having a sandpaper positioning function, wherein the user's one finger may extend through the opening of the annular flange and the concavity of the annular groove to detach the O-ring from the annular groove of the rotation wheel, thereby facilitating replacement of the sandpaper.

In accordance with the present invention, there is provided a finishing machine having a sandpaper positioning function, comprising:

a frame;

a rotation wheel rotatably mounted on the frame, the rotation wheel having a periphery formed with an annular flange radially extending inward, the annular flange of the rotation wheel having an inner periphery formed with an annular groove;

a sandpaper bonded on the rotation wheel; and an O-ring mounted on the rotation wheel and urged on the sandpaper, the O-ring being inserted into the annular groove of the rotation wheel and urged on the annular flange of the rotation wheel to position the sandpaper.

Further benefits and advantages of the present invention will become apparent after a careful reading of the detailed description with appropriate reference to the accompanying drawings.

DETAILED DESCRIPTION OF THE INVENTION

Figure 1:
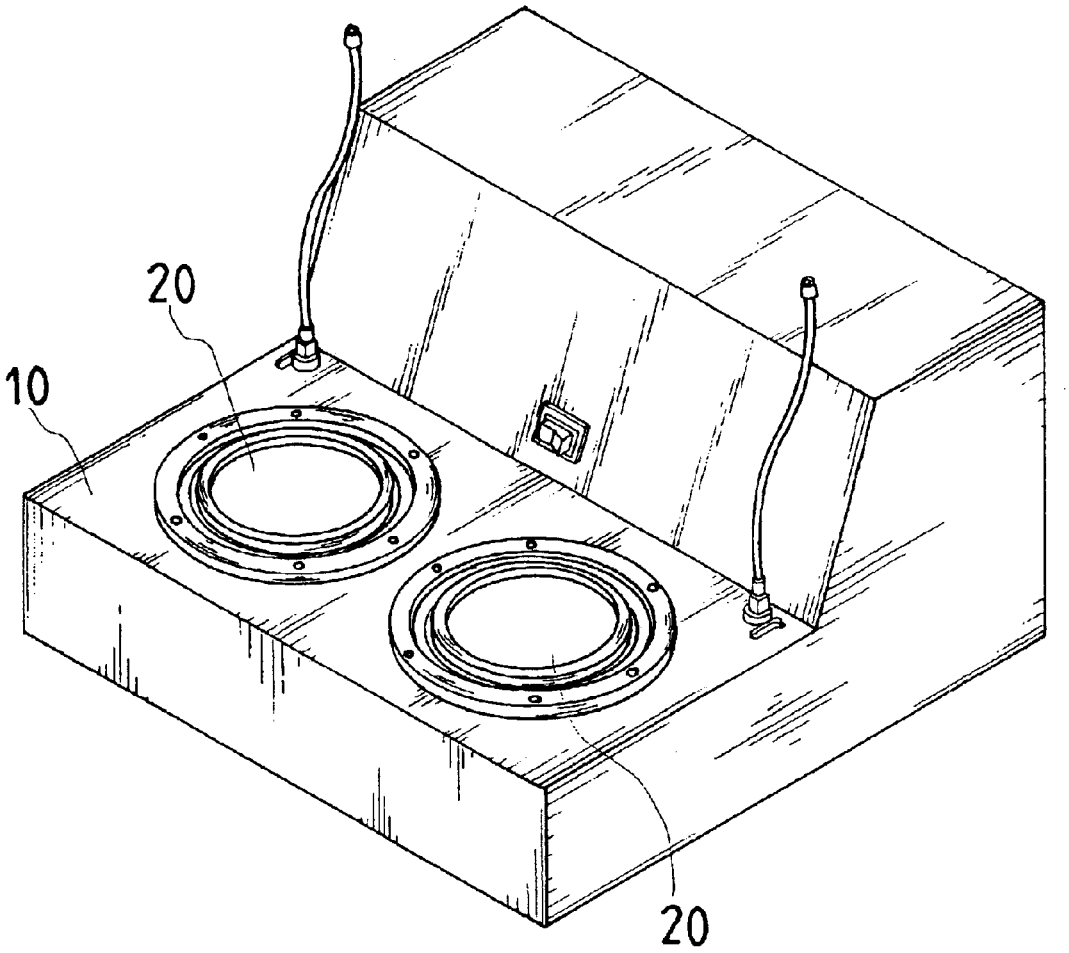
FIG. 1 is a perspective view of a finishing machine having a sandpaper positioning function in accordance with a preferred embodiment of the present invention.
Figure 2:
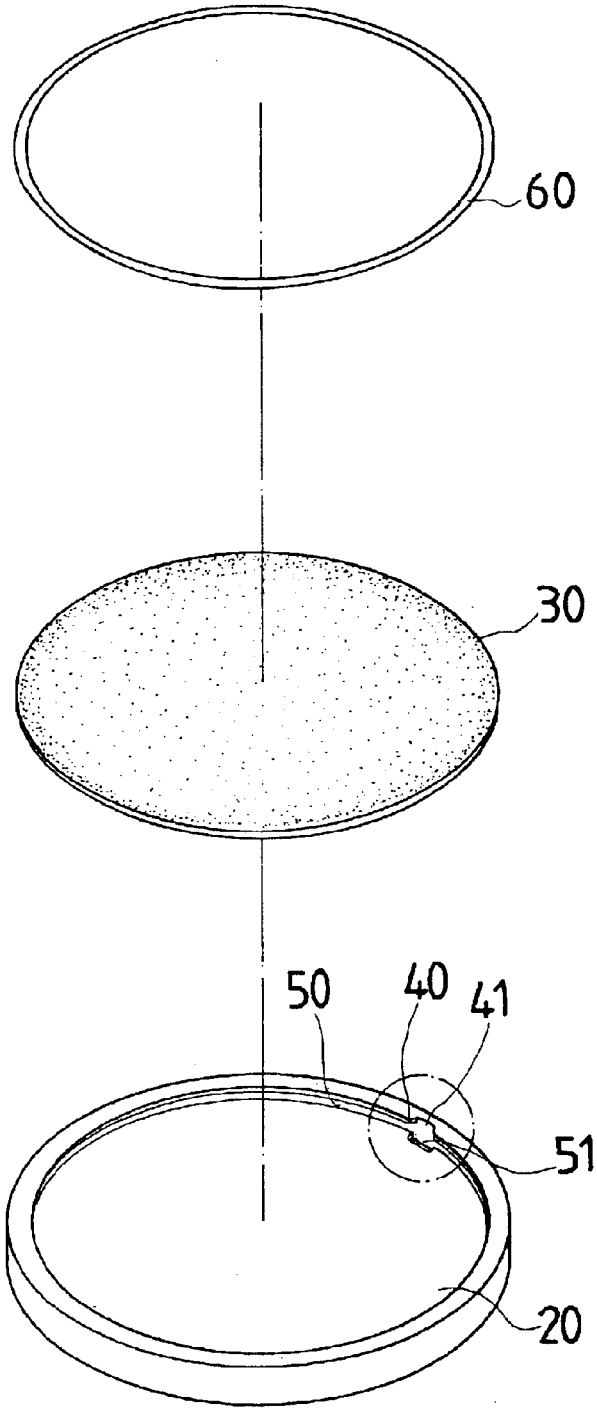
FIG. 2 is a partially exploded perspective view of the finishing machine having a sandpaper positioning function as shown in FIG. 1.
Figure 3:
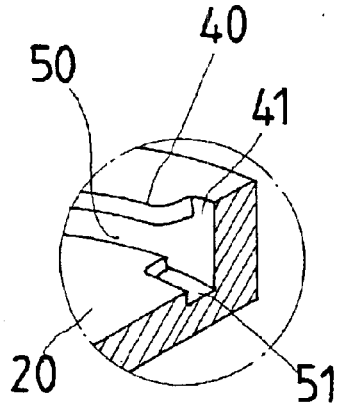
FIG. 3 is a partially enlarged cross-sectional view of the finishing machine having a sandpaper positioning function as shown in FIG. 2.
Figure 4:
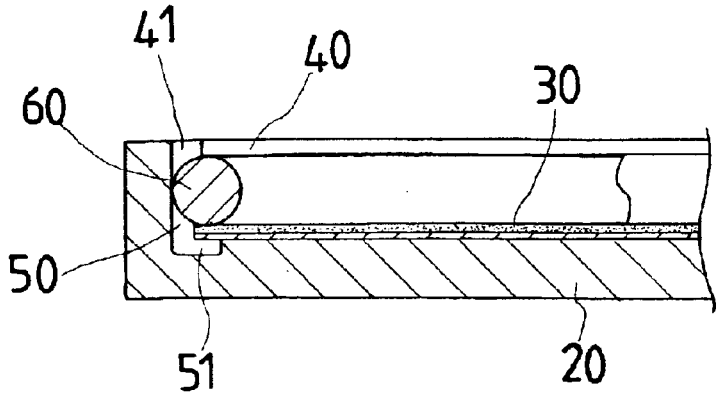
FIG. 4 is a partially cut-away plan cross-sectional assembly view of the finishing machine having a sandpaper positioning function as shown in FIG. 2.
Figure 6:
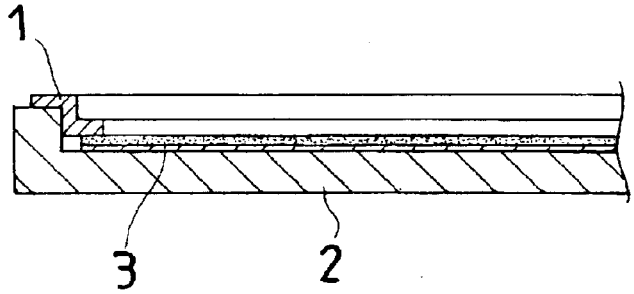
FIG. 6 PRIOR ART
FIG. 6 is a partially cut-away plan cross-sectional assembly view of the first conventional finishing machine as shown in FIG. 5.
Figure 8:
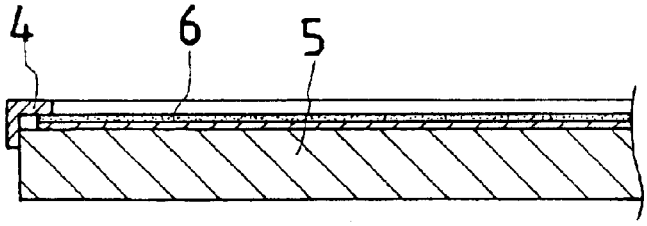
FIG. 8 PRIOR ART
FIG. 8 is a partially cut-away plan cross-sectional assembly view of the second conventional finishing machine as shown in FIG. 7.
Figure 5:
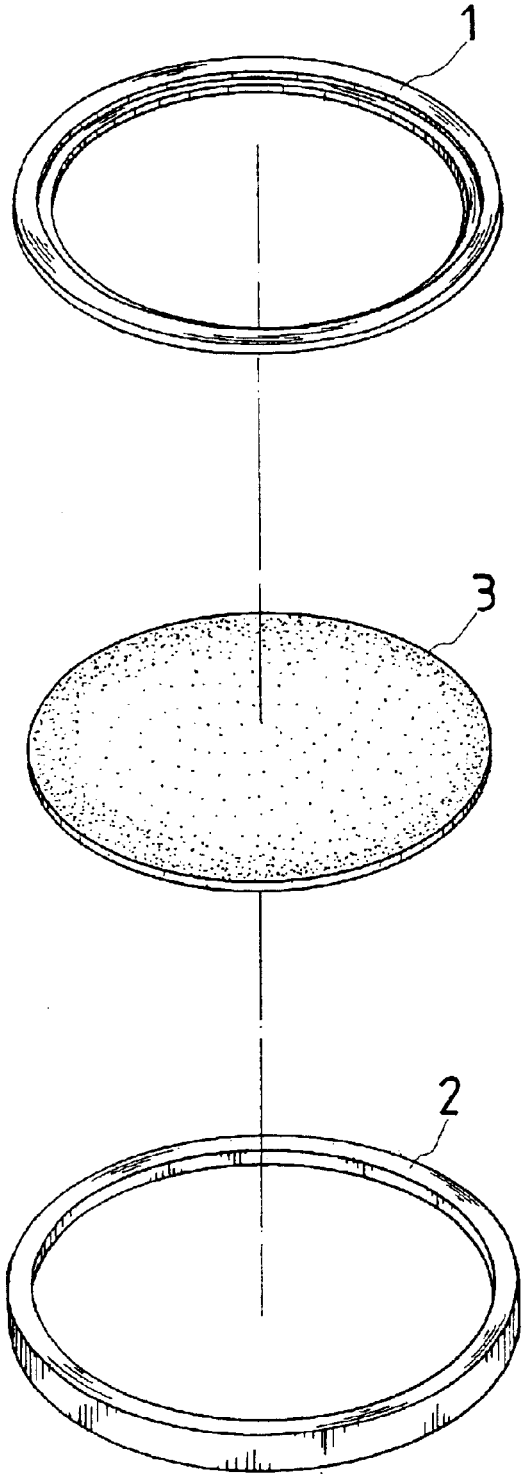
FIG. 5 PRIOR ART
FIG. 5 is a partially exploded perspective view of a first conventional finishing machine in accordance with the prior art.
Figure 7:
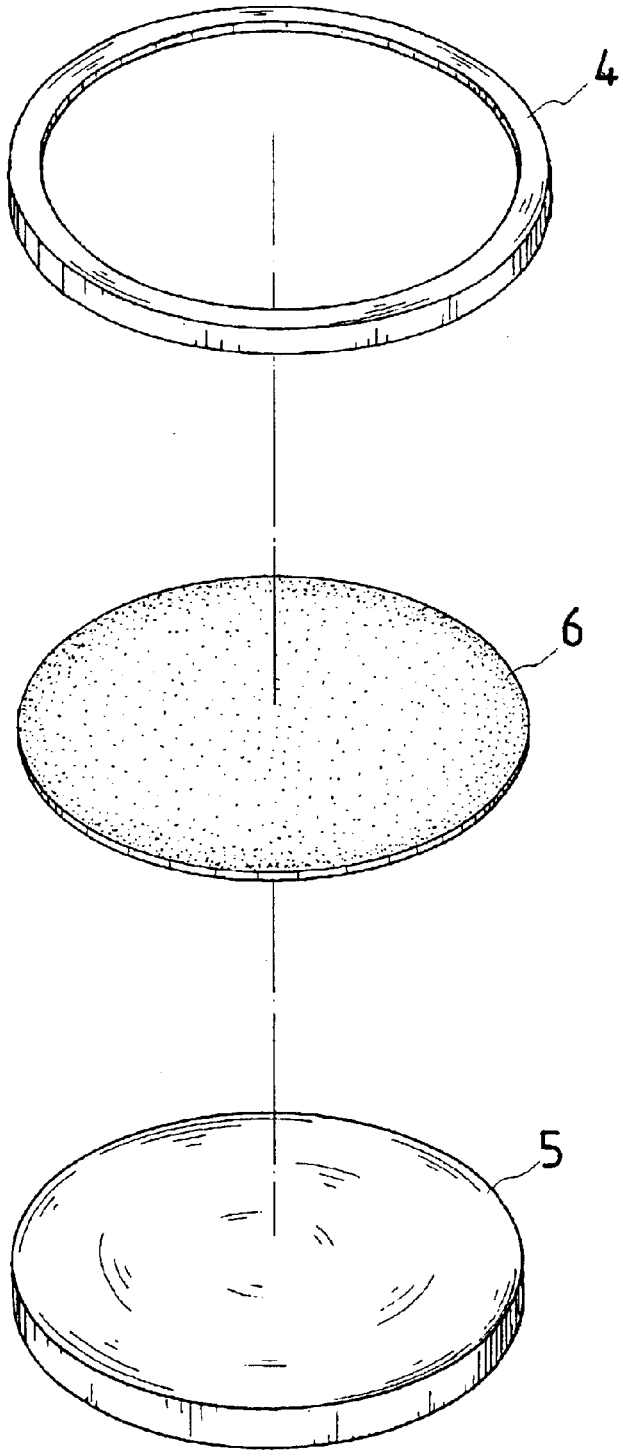
FIG. 7 PRIOR ART
FIG. 7 is a partially exploded perspective view of a second conventional finishing machine in accordance with the prior art.

Referring to the drawings and initially to FIGS. 1–3, a finishing machine having a sandpaper positioning function in accordance with a preferred embodiment of the present invention comprises a frame 10, two rotation wheels 20 each rotatably mounted on the frame 10, two sheets of sandpaper 30 each bonded on a respective one of the two rotation wheels 20 to rotate therewith, and two O-rings 60 each mounted on a respective one of the two rotation wheels 20 and each urged on a respective one of the two sheets of sandpaper 30. Thus, each of the two rotation wheels 20 is rotated at a high speed to rotate the sandpaper 30 so as to grind and finish the workpiece (not shown) on the sandpaper 30.

Each of the two rotation wheels 20 has a periphery formed with an annular flange 40 radially extending inward. The annular flange 40 of each of the two rotation wheels 20 has an inner periphery formed with an annular groove 50.

The annular flange 40 of each of the two rotation wheels 20 is formed with an opening 41. The annular groove 50 of each of the two rotation wheels 20 is formed with a concave 51 aligning with the opening 41 of the annular flange 40.

In assembly, referring to FIGS. 1–4, the sandpaper 30 is bonded on the top of each of the two rotation wheels 20. Then, the O-ring 60 is inserted into the annular groove 50 of each of the two rotation wheels 20, and is rested on the sandpaper 30. In such a manner, the O-ring 60 is pressed by the annular flange 40 of each of the two rotation wheels 20, so that the O-ring 60 is urged on the sandpaper 30 closely and tightly, thereby positioning the sandpaper 30 on each of the two rotation wheels 20 rigidly and stably.

The user's one finger may extend through the opening 41 of the annular flange 40 and the concavity 51 of the annular groove 50 to detach the O-ring 60 from the annular groove 50 of each of the two rotation wheels 20, thereby facilitating replacement of the sandpaper 30.

Accordingly, the O-ring 60 may function as a positioning device to position the sandpaper 30 on each of the two rotation wheels 20 rigidly and stably. In addition, the O-ring 60 has a cheap price, thereby decreasing cost of fabrication. Further, the O-ring 60 is made of soft material, thereby preventing the user from being injured.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A finishing machine having a sandpaper positioning function, comprising:

a frame;

a rotation wheel rotatably mounted on the frame, the rotation wheel having a periphery formed with an annular flange radially extending inward, the annular flange of the rotation wheel having an inner periphery formed with an annular groove, an opening defined in the annular flange and a concavity defined in the rotation wheel, the opening and the concavity both communicating with the annular groove and located in alignment with the concavity;

a sandpaper bonded on the rotation wheel; and an O-ring mounted on the rotation wheel and urged on the sandpaper, the O-ring being inserted into the annular groove of the rotation wheel and the annular flange of the rotation wheel pressing on the O-ring so as to position the sandpaper.

* * * * *